US008013708B2

(12) United States Patent
Tsai

(10) Patent No.: US 8,013,708 B2
(45) Date of Patent: Sep. 6, 2011

(54) PLANAR TRANSFORMER AND WINDING ARRANGEMENT SYSTEM BACKGROUND

(75) Inventor: Yu-Chi Tsai, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/717,899

(22) Filed: Mar. 4, 2010

(65) Prior Publication Data

US 2011/0148563 A1 Jun. 23, 2011

(30) Foreign Application Priority Data

Dec. 18, 2009 (CN) ..... 2009 1 0311758

(51) Int. Cl.
*H01F 5/00* (2006.01)

(52) U.S. Cl. ..... 336/200; 336/223; 336/232

(58) Field of Classification Search ..... None
See application file for complete search history.

(56) References Cited

U.S. PATENT DOCUMENTS

| | | | | |
|---|---|---|---|---|
| 4,816,784 | A * | 3/1989 | Rabjohn | 333/24 R |
| 6,914,508 | B2 * | 7/2005 | Ferencz et al. | 336/200 |
| 7,248,138 | B2 * | 7/2007 | Chiang et al. | 336/200 |
| 7,557,673 | B1 * | 7/2009 | Meharry | 333/25 |
| 2002/0149461 | A1 * | 10/2002 | Patel et al. | 336/200 |
| 2007/0001794 | A1 * | 1/2007 | Alford et al. | 336/200 |
| 2007/0176722 | A1 * | 8/2007 | Podlisk et al. | 336/200 |
| 2009/0261901 | A1 * | 10/2009 | Meharry | 330/124 R |

* cited by examiner

*Primary Examiner* — Anh Mai
(74) *Attorney, Agent, or Firm* — Altis Law Group, Inc.

(57) ABSTRACT

A winding arrangement system of a planar transformer includes a primary winding arranges on a number of first circuit layers of a printed circuit board (PCB), and two secondary winding arranged on a number of second circuit layers. The turns of the primary winding are coupled in series. Each second circuit layer has a winding turn. A first half of the winding turn belongs to one of the two secondary winding. A second half of the winding turn belongs to the other of the two secondary winding. The first and second halves of winding turns on each of the second secondary circuit layers share a common grounded node. All of the first halves of winding turns are coupled in parallel. All of the second halves of winding turns are also coupled in parallel.

9 Claims, 6 Drawing Sheets

PLANAR TRANSFORMER AND WINDING ARRANGEMENT SYSTEM BACKGROUND

BACKGROUND

1. Technical Field

The present disclosure relates to power conversion devices, and particularly to a planar transformer and a winding arrangement system in the planar transformer.

2. Description of Related Art

A transformer is usually used in a power supply device to convert voltage to a higher or a lower voltage. Devices with limited space use planar transformers, such as notebooks and mobile phones. The planar transformer is integrated onto a printed circuit board (PCB). Each layer of the PCB has an integer number of turns of a primary winding or a secondary winding of the planar transformer. However, the windings of the planar transformer arranged in this manner may induce a high output impendence and low efficiency, which causes noise.

DETAILED DESCRIPTION

Figure 1:
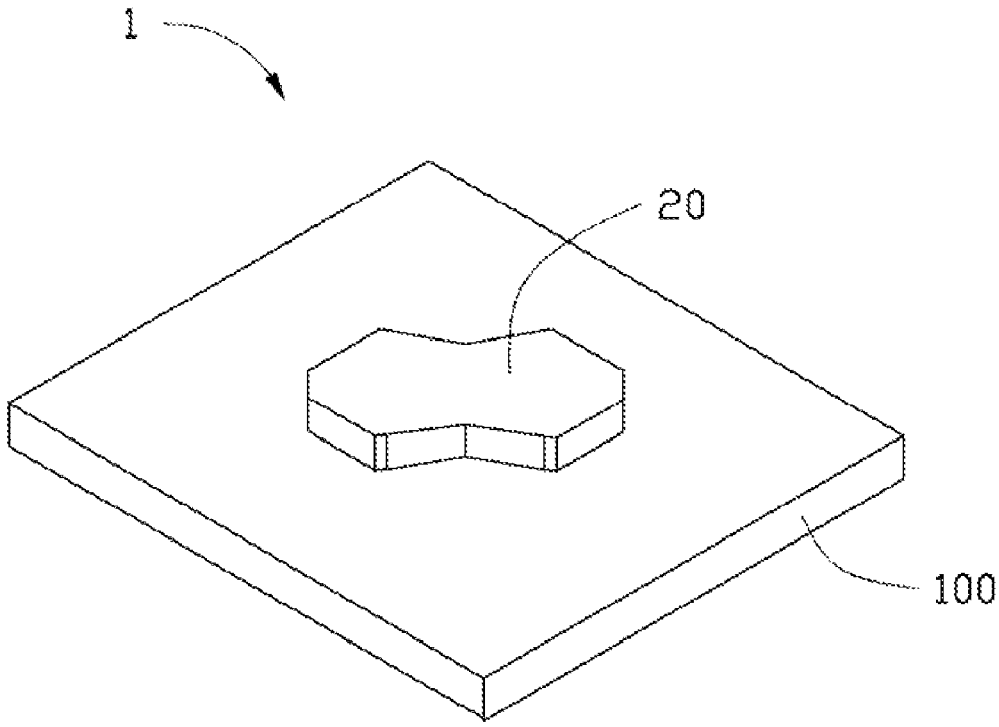
FIG. 1 is an isometric view of an embodiment of a planar transformer, the planar transformer includes a printed circuit board (PCB).
Figure 2:
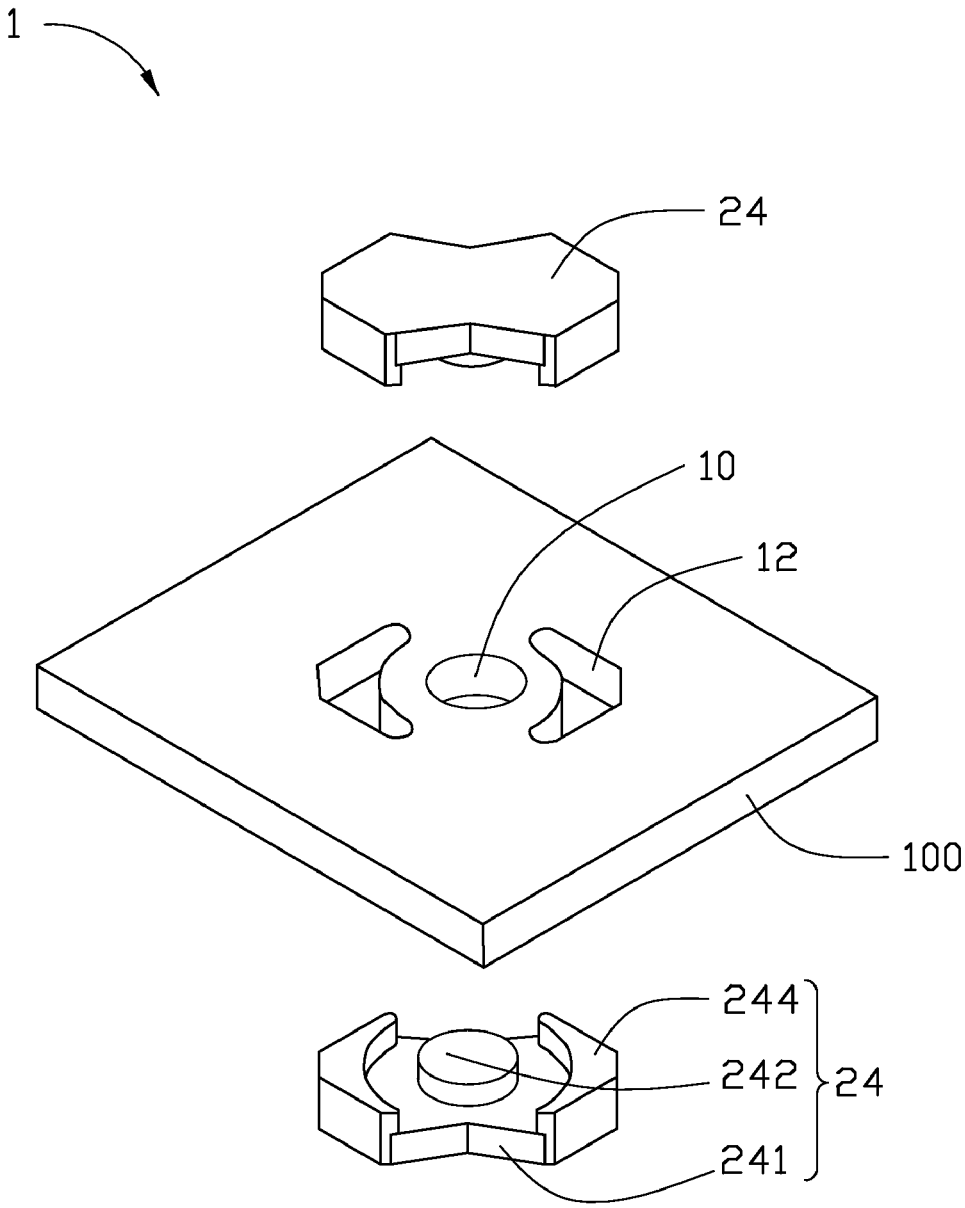
FIG. 2 is an exploded, isometric view of the planar transformer of FIG. 1.

Referring to FIGS. 1 and 2, an embodiment of a planar transformer 1 includes a printed circuit board (PCB) 100 and a magnetic core 20 mounted on the PCB 100. A substantially circular shaped through hole 10 is defined in the PCB 100. Two L-shaped through holes 12 are defined in the PCB 100, at opposite sides of the substantially circular shaped through hole 10. The through holes 10, 12 receive the magnetic core 20. The planar transformer 1 can be used in the power supply of an electronic device to convert a voltage to a higher or lower voltage.

The magnetic core 20 includes two parts 24. Each part 24 includes a first base 241, a circular first block 242 protruding up from a center of the base 241, and two L-shaped second blocks 244 protruding up from the base 241 at opposite sides of the first block 242. In another embodiment, the parts 24 forming the magnetic core 20 may have different structures and may not be identical. In assembly, the parts 24 are respectively attached to a top side and a bottom side of the PCB 100, with the first blocks 242 received in the through hole 10, and the second blocks 244 received in the corresponding through holes 12.

The PCB 100 includes a plurality of primary circuit layers and a plurality of secondary circuit layers. The planar transformer 1 includes a primary winding, a first secondary winding, and a second secondary winding, which are made of conductive material, such as copper. Each primary circuit layer includes at least one first winding turn arranged around the circular through hole 10. All of the first winding turns of the plurality of primary circuit layers connect in series to form the primary winding. Each secondary circuit layer includes a second winding turn arranged around the circular through hole 10. The first and second winding turns are made of conductive material laminated on the surface of the corresponding circuit layers. Each second winding turn includes a first half-turn and a second half-turn coupled together. All of the first half-turns connect in parallel to form the first secondary winding. All of the second half-turns connect in parallel to form the second secondary winding.

Figure 3:
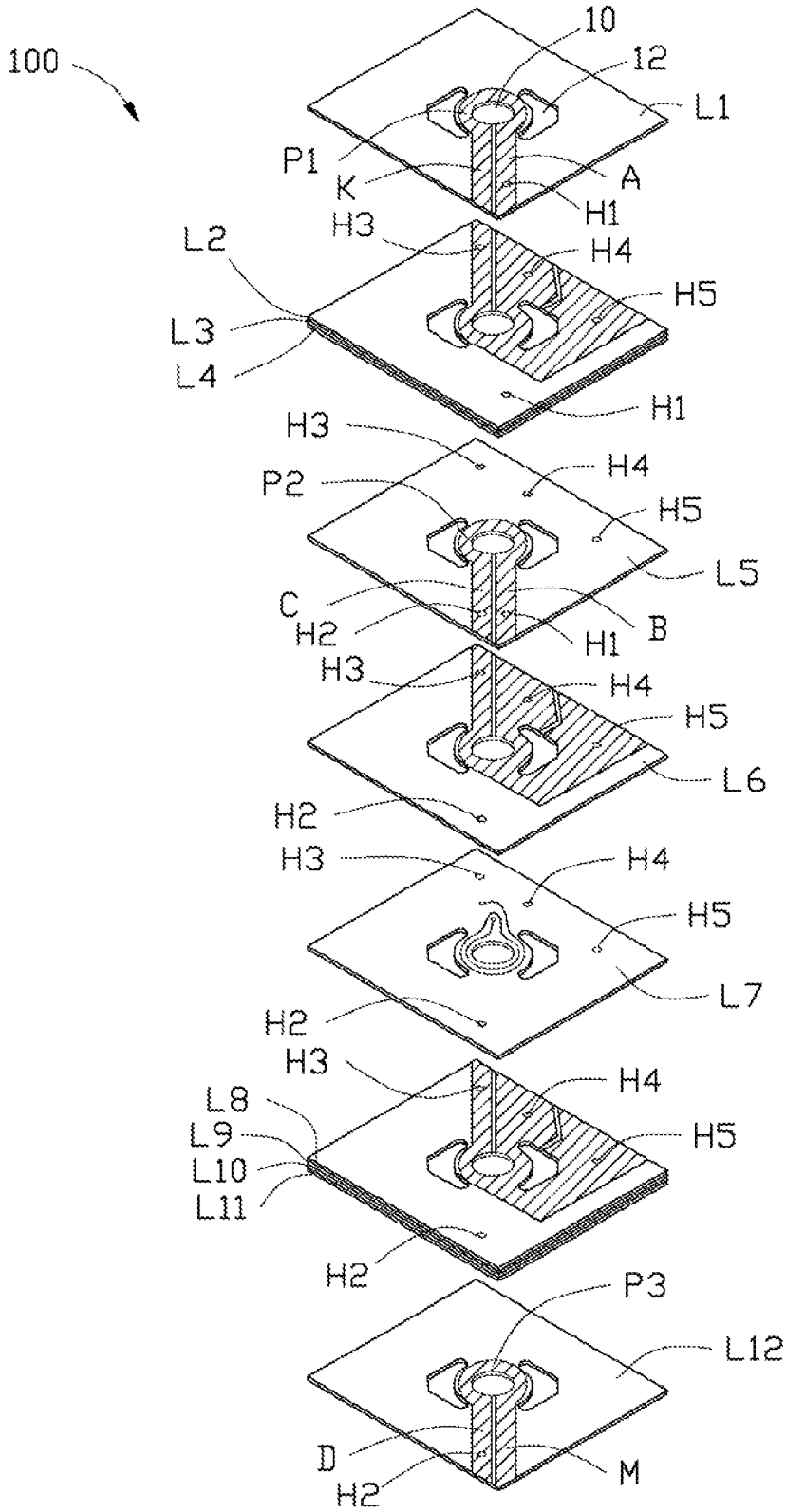
FIG. 3 is an exploded, schematic view of the PCB of FIG. 1, the PCB includes a secondary circuit layer.

Referring to FIG. 3, in the illustrated embodiment, the PCB 100 includes 12 circuit layers L1 through L12. The circuit layers L1, L5, and L12 are primary circuit layers. The circuit layers L2 through L4, L6, and L8 through L11 are secondary circuit layers. Three winding turns P1 through P3 are laminated on the circuit layers L1, L5, and L12, respectively, around the circular through hole 10.

A plurality of terminals A through D, K, and M extend from an end of the winding turn P1, a beginning of the winding turn P2, an end of the winding turn P2, a beginning of the winding turn P3, a beginning of the winding turn P1, and an end of the winding turn P3, respectively. The terminal A couples to the terminal B by a route H1, which passes through the circuit layers L1 through L5. The terminal C couples to the terminal D by a route H2, which passes through the circuit layers L5 through L12. Therefore, the winding turns P1 through P3 connect in series in that order, to form a primary winding. The number of turns of the primary winding is 3. The terminals K and M function as a non-inverting input terminal and an inverting terminal of the planar transformer 1, respectively.

Figure 4:
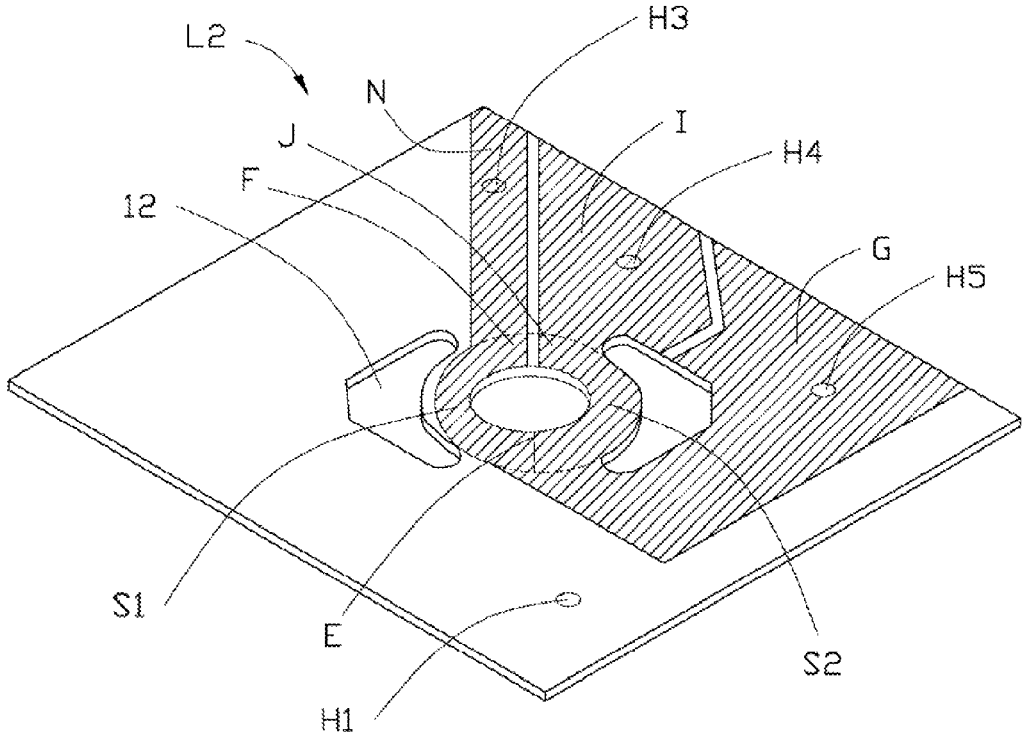
FIG. 4 is an enlarged, schematic diagram of the secondary circuit layer of FIG. 3.

Referring to FIG. 4, a structure of a secondary circuit layer, such as the circuit layer L2, will be described as follows. The dashed circle of FIG. 4 shows a winding turn arranged on the circuit layer L2. First and second halves of the winding turn denotes by S1 and S2 respectively. An end of the first half of the winding turn S1 couples to a beginning of the second half of the winding turn S2. E. denotes a node between the two halves of the winding turn S1 and S2. A non-inverting output terminal N extends from a beginning F of the first half of the winding turn S1. An inverting output terminal I extends from an end J of the second half of the winding turn S2. A ground terminal G extends from the node E between the two halves of the winding turn S1 and S2.

Each of the circuit layers L3, L4, L6, and L8 through L11 has a similar structure as the circuit layer L2. Three routes H3 through H5 pass through the circuit layers L2 through L11. The route H3 couples the non-inverting output terminals N on all of the circuit layers L2 through L4, L6, and L8 through L11 The inverting output terminals I on all of the circuit layers L2 through L4, L6, and L8 through L11 couple to one another by the route H4. The ground terminals G on all of the circuit layers L2 through L4, L6, and L8 through L11 couple to one another by the route H5. Therefore, all of the halves of the winding turn S1 connect in parallel to form a first secondary winding. All of the halves of the winding turns S2 connect in parallel to form a second secondary winding. The number of turns of each of the first and second secondary windings is about 0.5. The turn ration of the primary winding and each of the first and secondary windings is about 3:0.5.

The circuit layer L7 is an auxiliary power layer which includes a spiral winding laminated thereon. The spiral winding is arranged around the circular through hole 10, to provide an auxiliary power. Arrangement of an auxiliary power layer is a recognized technology in the art.

Figure 5:
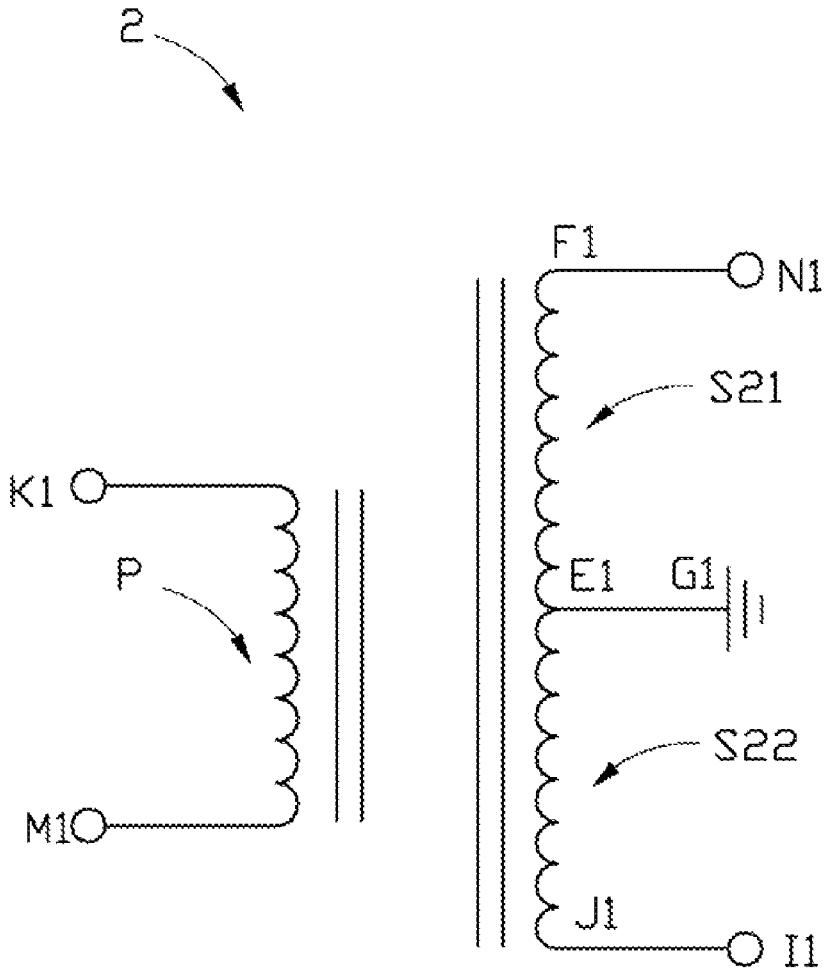
FIG. 5 is an equivalent circuit diagram of the planar transformer of FIG. 1.

Referring to FIG. 5, it shows an equivalent circuit 2 of the planar transformer 1. The equivalent circuit 2 includes a primary winding P, and two secondary windings S21 and S22. The secondary winding S21 has a first end F1. The secondary winding S22 has a first end J1. Second ends of the secondary windings S21 and S22 connect at a node E1. A non-inverting input terminal K1 and an inverting input terminal M1 extend from two ends of the primary winding P, respectively. A non-inverting output terminal N1 and an inverting output terminal I1 of the equivalent circuit 2 extend from the first ends F1 and J1 respectively. A ground terminal G1 extends from the node E1. To perform a full wave rectification, the primary winding P, and the two secondary windings S21 and S22, can be couple. The symbols K, M, I, N, I, G, F, and J of FIGS. 3 and 4 are respectively equivalent to the symbols K1, M1, N1, I1, G1, F1, and J1 of FIG. 5.

The planar transformer 1 has higher performances than a conventional planar transformer which has 6 turns of primary winding and one turn of secondary winding, although the value of the turns ratio and the circuit layer number of the PCB are unchanged. Performances of the planar transformer 1 and the conventional transformer will be compared as detailed below.

An output impendence of a planar transformer can be obtained according to the equation: R=ρ*L/A, wherein R is the output impendence, ρ is a constant coefficient, L is a sum of lengths of a primary winding and two secondary windings, and A is a an effective cross sectional area of the primary or secondary winding. The conventional transformer needs five primary circuit layers to arrange the 6 turns of primary winding (one of the five primary circuit layers has two turns of primary winding arranged thereon), an auxiliary power layer, and six secondary circuit layers to arrange the two secondary windings, each of which has three turns connected in parallel. However, because the planar transformer 1 has 8 secondary circuit layers L2 through L4, L6, and L8 through L11 to arrange the two secondary windings, each of which has 8 halves of turns connected in parallel. Further, the sum of the lengths of the primary winding and the two secondary windings of the planar transformer 1 is half the conventional transformer. Therefore, the output impendence of the planar transformer 1 is three sixteenths (3/(8*2)) of the conventional transformer. For example, if the output impendence of the conventional transformer is 0.736 milliohm, the output impendence of the planar transformer 1 is 0.138 milliohm.

As illustrated in FIG. 4, a copper loss of the planar transformer 1 can be obtained by adding the copper losses of three sections of copper. The three sections of copper may include the half of the winding turn S1, the non-inverting output terminal N, and the ground terminal G. Alternatively, the three sections of copper may include the half of the secondary winding turn S2, the inverting output terminal I, and the ground terminal G. A copper loss of a conventional planar transformer can also be obtained by adding copper losses of three sections of copper. The three sections of copper include a whole turn of secondary winding, an output terminal, and a ground terminal of the conventional transformer. The copper loss of each section of copper can be determined according to the formula: I*I*R, wherein I is an output current, and R is the output impendence. In one example, the planar transformer 1 and the conventional planar transformer have the same output voltages, such as 1.8 volts (V), and the same output currents, such as 40 amperes (A). Output powers of both the planar transformer 1 and the conventional transformer are 40 A*1.8V=72 watts (W), the copper loss of each section of copper of the conventional transformer is 40 A*40 A*0.736 milliohm=1.178 W. The output copper loss of the conventional transformer is 1.178 W*3=3.534 W, which is 4.9% of the output power. The copper loss of each section of copper of the planar transformer 1 is 40 A*40 A*0.138 milliohm=0.22 W. The output copper loss of the planar transformer 1 is 0.22 W*3=0.66 W, which is 0.9% of the output power. Therefore, the output copper loss of the planar transformer 1 is decreased by 4%.

Figure 6:
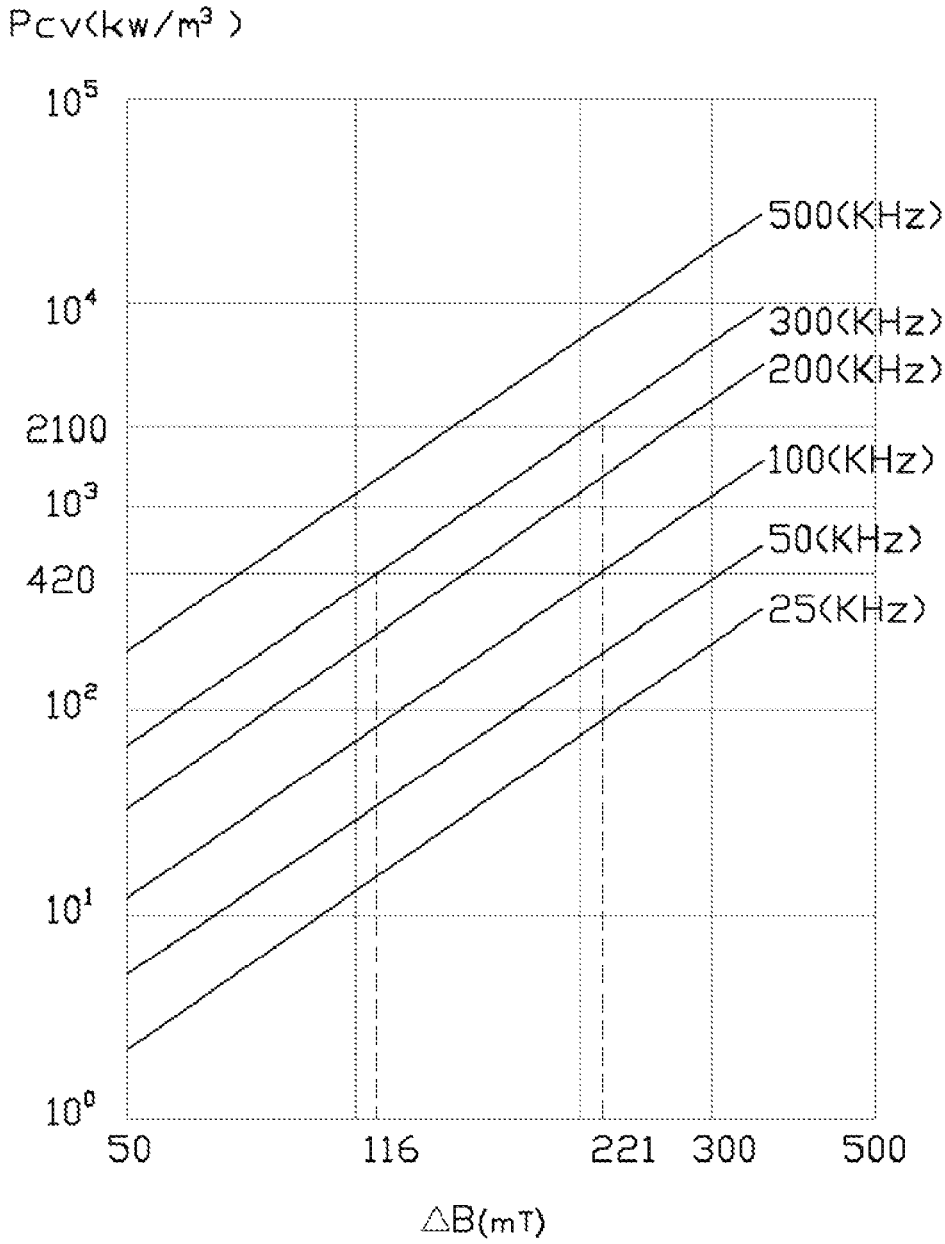
FIG. 6 is a diagram showing relationships among an operation frequency, a magnetic field density, and a core loss of the planar transformer of FIG. 1.

Referring to FIG. 6, a core loss of a planar transformer can be determined according to the following equation: $P_{core_loss} = P_{cv}$*Ve, wherein $P_{cv}$ is a bulk density of the core, Ve is an effective volume of the core. A magnetic field density of a planar transformer can be determined according to the following equation:

$$\Delta B = \frac{Vin * D\max}{Np * Ae * Fsw},$$

wherein Vin is an input voltage of the planar transformer. D max is a duty cycle of the input voltage Vin, Np is a number of turns of the primary winding of the transformer, Ae is an effective area of the core, and Fsw is an operation frequency of the planar transformer. In this example, the effective volume Ve is 840 cube millimeters ($mm^3$), the input voltage Vin is 13V, the duty cycle D max is 0.5, the effective area Ae is 31 square millimeters ($mm^2$), and the operation frequency is 300 kilo-hertzs (KHz). Since the number of turns of the primary winding of the conventional planar transformer is 6, the magnetic field density ΔB of the conventional planar transformer is 0.116 tesla (T). Since the number of turns of the primary winding of the planar transformer 1 is 3, the magnetic field density ΔB of the planar transformer 1 is 0.215 T. It can be determined from the relationship along the operation frequency Fsw, the magnetic field density ΔB, and the core loss as shown in FIG. 6, that when the operation frequency Fsw is 300 KHz, the core loss of the conventional planar transformer is 0.42 W, whereas the core loss of the planar transformer 1 is 2.1 W. Therefore, the core loss of the conventional planar transformer is 0.58% of the output power, and the core loss of the planar transformer 1 is 2.9% of the output power. Therefore, the core loss of the planar transformer 1 increased 2.32%.

An efficiency of the planar transformer 1 is increased by 1.68% (4%−2.32%), although the core loss is increased. Because each circuit layer can arrange a half turn of the first secondary winding and a half turn of the second secondary winding, the first and second secondary windings can be arranged on more circuit layers, to reduce the output impendence and eliminate noise. Furthermore, since the number of the turns of windings are decreased, routes for connecting the windings are also decreased to reduce output impendence effected by large numbers of routes. Therefore, electronic devices may have higher performances when using the planar transformer 1.

The foregoing description of the embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A planar transformer comprising:

a printed circuit board (PCB) comprising a plurality of primary circuit layers, a plurality of secondary circuit layers, and a through hole passing through the PCB for receiving a core;

at least one first winding turn arranged on each of the plurality of primary circuit layers around the through hole, the at least one first winding turn of the plurality of primary circuit layers are coupled in series to form a primary winding; and a second winding turn arranged on each of the plurality of secondary circuit layers around the through hole, wherein a first half of the second winding turn functions as a first secondary winding turn, and a second half of the second winding turn functions as a second secondary winding turn, a node between the first and second halves of the second winding turn is grounded, the first secondary winding turns of the plurality of secondary circuit layers are coupled in parallel to form a first secondary winding, the second secondary winding turns of the plurality of secondary circuit layers are coupled in parallel to form a second secondary winding.

2. The planar transformer of claim 1, wherein the first and second winding turns are made of conductive material laminated on a corresponding primary circuit layer or a corresponding secondary circuit layer of the PCB.

3. The planar transformer of claim 1, wherein two sections of conductive material extend from two ends of the second winding turn, to function as a non-inverting terminal and an inverting terminal respectively, and a section of conductive material extends from the node between the first and second halves of the second winding turn to function as a ground terminal.

4. The planar transformer of claim 3, wherein a plurality of first vias is defined in the PCB to couple the at least one first winding turn in series, a second via is defined in the PCB to couple the non-inverting terminals extending from the first secondary winding turns, a third via is defined in the PCB to couple the inverting terminals extending from the second secondary winding turns, and a fourth via is defined in the PCB to couple the ground terminals extending from the nodes between the first and second halves of the second winding turns.

5. A winding arrangement system of a planar transformer, the system comprising:

a primary winding comprising a plurality turns of conductive material coupled in series, the plurality of turns of conductive material is arranged on a plurality of first circuit layers of a printed circuit board (PCB) correspondingly; and a first secondary winding comprising a plurality of first sections of conductive material coupled in parallel, each of the plurality of first sections of conductive material is arranged in a first half turn on a corresponding second circuit layer of the PCB; and a second secondary winding comprising a plurality of second sections of conductive material coupled in parallel, each of the plurality of second sections of conductive material is arranged in a second half turn on a corresponding second circuit layer of the PCB; wherein the first and second sections of conductive material on each of the second circuit layers, form a winding turn, and share a common grounded node.

6. The system of claim 5, wherein each of the primary winding and the winding turn formed by the first and second sections of conductive material are arranged around a through hole defined in the PCB.

7. The system of claim 5, wherein a third section of conductive material extends from an end of each of the plurality of first sections of conductive material, a fourth section of conductive material extends from an end of each of the plurality of second sections of conductive material, and a fifth section of conductive material extends from the common grounded node between each first section of conductive material and a corresponding second section of conductive material; the third sections of conductive material are coupled to function as a non-inverting terminal, the fourth sections of conductive material are coupled to function as an inverting terminal, and the fifth sections of conductive material are coupled to function as a ground terminal.

8. The system of claim 5, wherein the conductive material is copper.

9. A winding arrangement system of a planar transformer which comprises a printed circuit board (PCB) having a plurality of first circuit layers and a plurality of second circuit layers, the system comprising:

a primary winding comprising a plurality turns of conductive material arranged on the plurality of first circuit layers correspondingly, and coupled in series;

a first secondary winding comprising a plurality of first sections of conductive material each arranged on a first part of a corresponding second circuit layer; and a second secondary winding comprising a plurality of second sections of conductive material each arranged on a second part of the corresponding second circuit layer; wherein the first and second sections of conductive material on each of the plurality of second circuit layers form a turn of winding and share a common grounded node the first sections of conductive material are connected in parallel, and the second sections of conductive material are connected in parallel.

* * * * *